US006932528B2

(12) United States Patent
Heiles et al.

(10) Patent No.: US 6,932,528 B2
(45) Date of Patent: Aug. 23, 2005

(54) CUTTER POSITION CONTROL IN A WEB FED IMAGING SYSTEM

(75) Inventors: Tod Heiles, Vancouver, WA (US); Hsue-Yang Liu, Vancouver, WA (US); Brooke Smith, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 43 days.

(21) Appl. No.: 10/731,910

(22) Filed: Dec. 8, 2003

(65) Prior Publication Data

US 2005/0123335 A1 Jun. 9, 2005

(51) Int. Cl.[7] ..... B41J 15/24

(52) U.S. Cl. ..... 400/621; 400/582; 101/485

(58) Field of Search ..... 400/621, 706, 400/579–582, 708; 101/224–232, 248, 279, 101/481–485; 226/2, 24, 27, 28, 32; 83/37, 83/38, 74–76; 347/101

(56) References Cited

U.S. PATENT DOCUMENTS

| | | | | |
|---|---|---|---|---|
| 4,287,797 | A * | 9/1981 | Seragnoli | 83/74 |
| 5,961,233 | A * | 10/1999 | Sano | 400/621 |
| 6,092,466 | A * | 7/2000 | Koch et al. | 101/485 |
| 6,232,594 | B1 | 5/2001 | Eccher et al. | |
| 6,256,474 | B1 * | 7/2001 | Gibisch et al. | 399/384 |
| 6,402,405 | B1 * | 6/2002 | Frodl et al. | 400/582 |
| 6,536,892 | B1 | 3/2003 | Chang et al. | |
| 6,616,263 | B2 | 9/2003 | Allen et al. | |
| 6,814,514 | B2 * | 11/2004 | Korngold et al. | 400/621 |

* cited by examiner

*Primary Examiner*—Minh Chau

(57) ABSTRACT

A method for locating a cutter in a web fed photo imaging system including the steps of measuring an actual fiducial distance between consecutive fiducials, comparing a measured actual fiducial distance between consecutive fiducials to an imaging engine feed distance, calculating a feed distance scaling factor equal to a difference between an average actual fiducial distance and the imaging engine feed distance divided by a total number of discrete incremental moves between fiducials and adjusting the imaging engine feed distance in an amount equal to the scaling factor.

18 Claims, 4 Drawing Sheets

CUTTER POSITION CONTROL IN A WEB FED IMAGING SYSTEM

FIELD OF THE INVENTION

This invention relates to image forming systems, and more particularly to a device which renders an image on a print media that is subsequently trimmed along an edge.

BACKGROUND OF THE INVENTION

In a web fed photo imaging system a cutter separates consecutive images one from the next. It is preferable that the cutter be precisely located relative to the images being cut so that the resulting trimmed image has a uniform and finished appearance. Currently, a cut position in a web feed axis is referenced employing a sensor that reads a fiducial printed at the start of a print job by the imaging system. The system relies on open loop control of the cutter drive system to position the cuts relative to the fiducial.

Variations in the drive systems between the imaging engine and the cutter, along with media expansion may cause scaling errors that result in misalignment between the cuts and image boundaries.

It may be desirable to utilize a device or method for monitoring an average distance between job fiducials and comparing this value to a theoretical feed distance specified by or measured at the imaging engine, and calculating a scaling factor to adjust the actual fiducial distance so that cuts are more accurately located.

SUMMARY OF THE INVENTION

The present invention is directed to a method for locating a cutter in a web fed photo imaging system including the steps of measuring an actual fiducial distance between consecutive fiducials, calculating an average actual fiducial distance between consecutive fiducials, calculating a feed distance scaling factor equal to a difference between the average actual fiducial distance and the imaging engine feed distance divided by a total number of discrete incremental moves between fiducials and adjusting the imaging engine feed distance in an amount equal to the scaling factor.

DETAILED DESCRIPTION OF THE INVENTION

Figure 1:
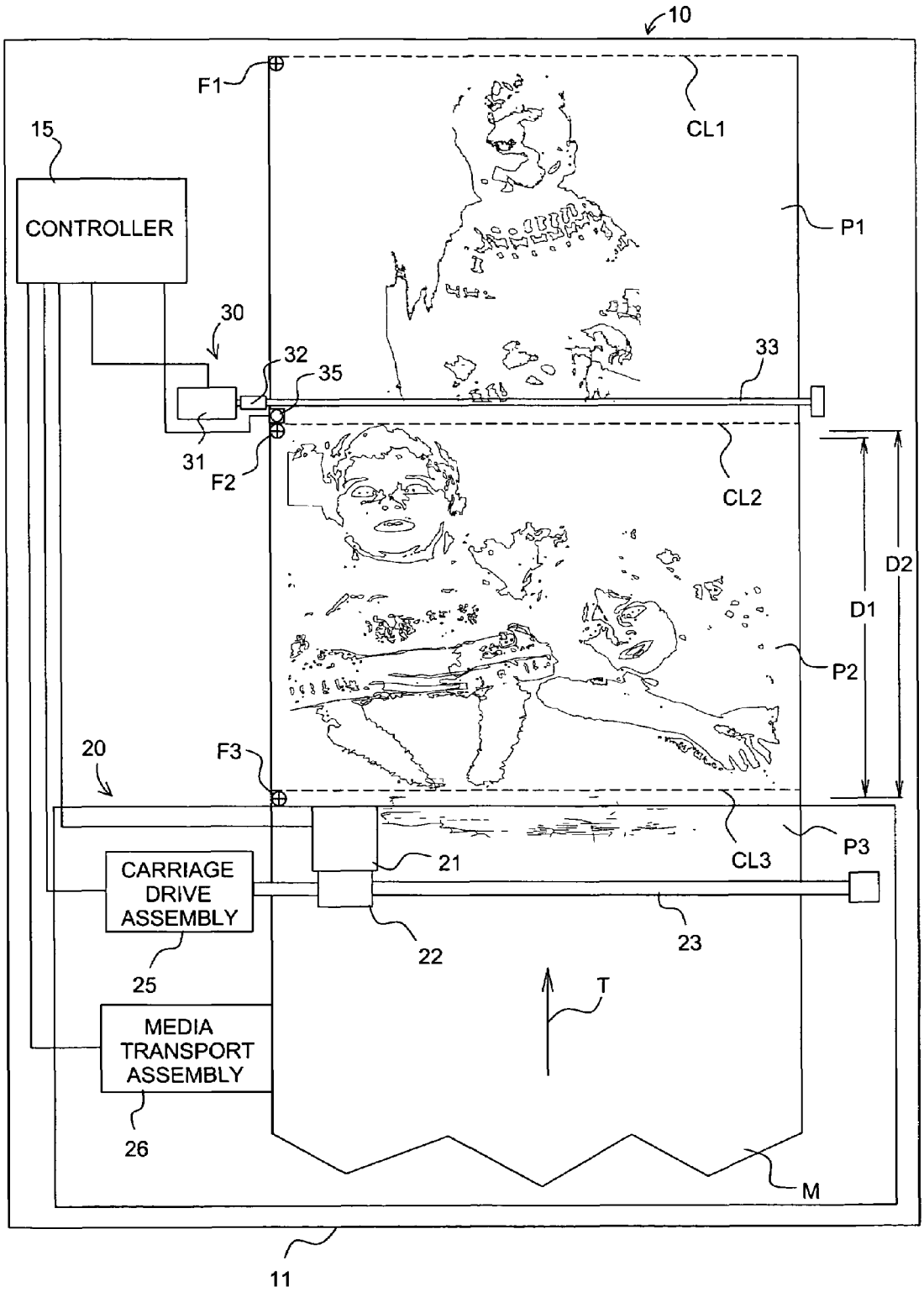
FIG. 1 is a schematic diagram depicting an imaging device which employs a method for locating a cutter in a web fed photo imaging system according to one embodiment of the present invention.
Figure 2:
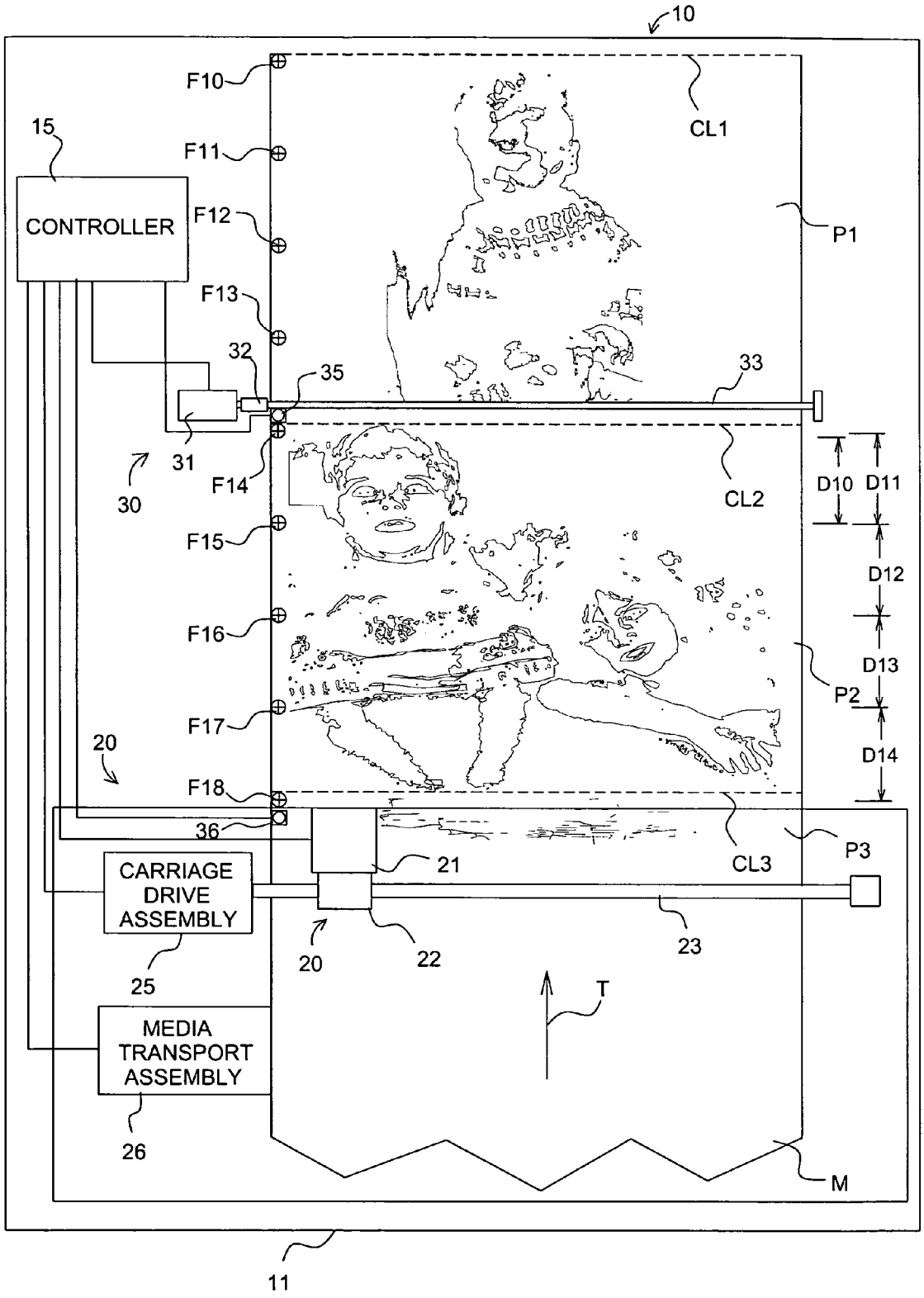
FIG. 2 is a schematic diagram depicting an imaging device which employs a method for locating a cutter in a web fed photo imaging system according to one embodiment of the present invention.

FIGS. 1 and 2 are representative schematic diagrams depicting an imaging device 10 which employs a method for locating a cutter in a web fed photo imaging system according to one embodiment of the present invention. Referring to FIG. 1, imaging system 10. Imaging system 10 includes housing 11 which provides a structural enclosure for controller 15 and the connected imaging engine 20. Controller 15 controls various functions of imaging system 10, including operation of imaging engine 20. As seen in FIG. 1, media M is transported through imaging engine in direction T by operation of media transport assembly 26.

Imaging engine 20 includes print head 21 mounted to carriage 22 which traverses carriage rod 23 by operation of carriage drive assembly 25. Although the detailed embodiment is described as an inkjet type device, the present invention is not necessarily intended to be limited to inkjet type imaging devices. Imaging system 10 also includes cutter assembly 30 which is connected to controller 15 and includes media cutter 32 which is transported across cutter rod 33. Sensor 35 is also shown located adjacent to cutter assembly 30 and is connected to controller 15. As shown in FIG. 2, according to one aspect of the present invention, imaging device 10 may also include a second sensor 36 included at print engine 20. Sensor 36 is connected to controller 15 and may provides a value representative of imaging engine feed distance to controller 15.

Referring to FIG. 1, fiducials F1, F2 and F3 are shown printed along a margin of media M. Similarly, fiducials F10 through F18 are shown printed along a margin of media M in FIG. 2. Imaging engine feed distance D1 represents a theoretical distance between fiducials F2 and F3, as shown in FIG. 1. Similarly, imaging engine feed distance D10 represents a theoretical distance between fiducials F14 and F15, as shown in FIG. 2. The location and therefore the theoretical distance between any two consecutive fiducials are specified by the imaging engine 20. The actual fiducial distance D2, as shown, in FIG. 1, is slightly greater than imaging engine feed distance D1. Similarly, the actual fiducial distances D11 through D14, shown, in FIG. 2, are slightly greater than imaging engine feed distance D10. The actual fiducial distances D2, shown in FIG. 1, and D11 through D14, shown, in FIG. 2, represent an actual distance between any two consecutive fiducials that may be attributable to a variety of factors including variations in the operation of media transport assembly 26 and the cutter assembly 30 or media expansion or contraction due to the imaging process including drying and laminating processes employed which may cause scaling errors that result in misalignment between the cuts and the image boundaries.

The inkjet imaging process is a discrete feed process. As such, media M is advanced by a predetermined increment, dependent upon the resolution of a desired image. In one embodiment, the predetermined increment or "discrete increment" equals $^{64}/_{600}$ths of an inch. Media transport assembly 26 advances media M a distance equal to $^{64}/_{600}$ths of an inch. Media M stops and carriage 22 traverses carriage rod 23 printing a swath of image data. When the swath is completed, media M is again advanced by the discrete increment. Media transport assembly 26 is responsive to controller 15 and the input of sensor 35.

According to one aspect of the present invention, each discrete increment is adjusted by a scaling factor equal to a difference between an average actual fiducial distance and the imaging engine feed distance divided by a total number of discrete incremental moves between fiducials. For example, referring to FIG. 1, assuming that the imaging engine feed distance D1 is equal to 8.0000 inches and the actual fiducial distance D2 between fiducials F2 and F3 is equal to 8.1250, the scaling factor would be equal to ((8.1250)−8.0000)/(8.0000/64/600), or 0.00167 inches.

Similarly, referring to FIG. 2, assuming that the imaging engine feed distance D10 is equal to 2.0000 inches and the actual fiducial distance D11 between fiducials F14 and F15 is equal to 2.0250 inches, the actual fiducial distance D12 between fiducials F15 and F16 is equal to 2.0150 inches, the actual fiducial distance D13 between fiducials F16 and F17 is equal to 2.0220 inches and the actual fiducial distance D14 between fiducials F17 and F18 is equal to 2.0350, the scaling factor would be equal to $(((2.0250+2.0150+2.0220+2.0350)/4)-2.0000)/(2.0000/{}^{64}/_{600})$, or 0.00129 inches. Therefore, in accordance with the present invention, each discrete incremental advance of the media is adjusted by the scaling factor. For instance in the first example each discrete incremental would equal $^{64}/_{600}$ inches minus 0.00167 inches or 0.10500 inches. Similarly, according to the second example, each discrete incremental would be adjusted to equal $^{64}/_{600}$ inches minus 0.00129 inches or 0.10537 inches.

According to another aspect of the present invention, when a fiducial, for instance fiducial F2, shown in FIG. 1 or fiducial F14, shown in FIG. 2, is sensed, media transport assembly 26 receives a command from controller 15 to advance media M by a preselected distance to position the cutline, for instance CL2 in a desired location beneath cutter 32. Where the preselected distance required to position the cutline, beneath cutter 32 may equals a fraction of a discrete increment, media transport assembly 26 is instructed to advance a distance of $F\times{}^{64}/_{600}$, where $F\leqq 1$, to position the cutline. Following the traverse of cutter 32 across cutter rod 33, media M is advanced a distance equal to the remainder of the discrete increment before the next swath is printed, $^{64}/_{600}-(F\times{}^{64}/_{600})$.

Referring to FIG. 2, fiducials F10 through F18 are shown printed along a margin of media M. When sensor 35 senses a specified fiducial, cutter assembly 30 is actuated and media cutter 32 traverses a cutline for example CL1, CL2 or CL3 separating one image from the next, for example P1 from P2 or P2 from P3. It has been observed that the closer the distance between consecutive fiducials, the less the actual fiducial distance D2 must be adjusted as feed errors do not have much distance in which to accumulate. Applying this reasoning, it will be recognized by those skilled in the art that the accuracy of the method of the present invention can be further enhanced by printing a continuous set of fiducials or an encoder onto media M and synchronizing the actual fiducial distance D2 with the imaging engine feed distance D1 between fiducials F10 and F18 specified by the imaging engine 20 on at a relatively high frequency. By continuously calculating the distances between sequential fiducials, the scaling factor and the imaging feed distance can be "dynamically" updated to maintain accurate location of cutlines.

Figure 3:
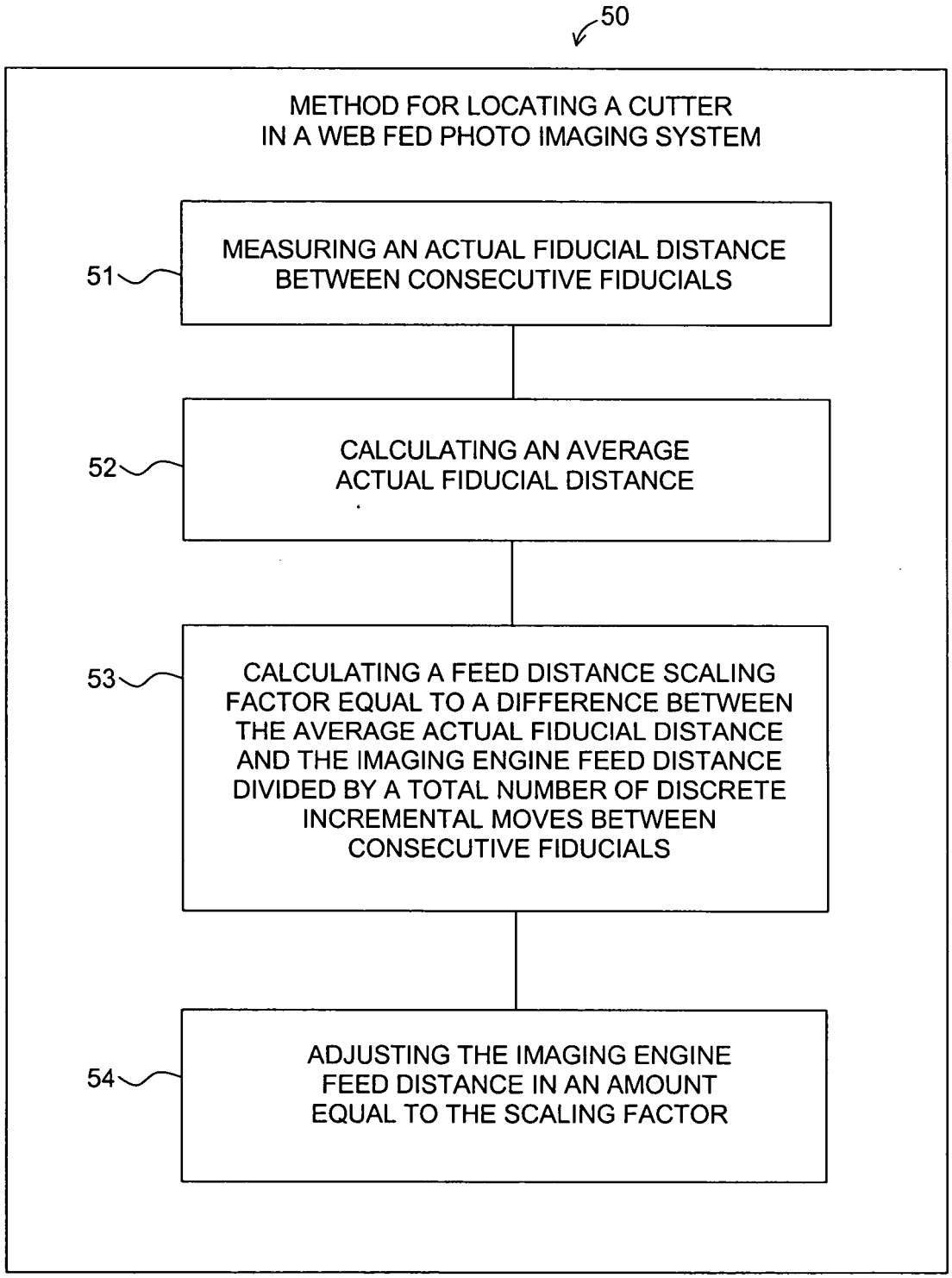
FIG. 3 is a schematic flow chart depicting a method for locating a cutter in a web fed photo imaging system according to one embodiment of the present invention.

Referring to FIG. 3, a METHOD FOR LOCATING A CUTTER IN A WEB FED PHOTO IMAGING SYSTEM 50 is shown to advantage. The METHOD FOR LOCATING A CUTTER IN A WEB FED PHOTO IMAGING SYSTEM 50 includes the steps of MEASURING AN ACTUAL FIDUCIAL DISTANCE BETWEEN CONSECUTIVE FIDUCIALS 51, CALCULATING AN AVERAGE ACTUAL FIDUCIAL DISTANCE 52, CALCULATING A FEED DISTANCE SCALING FACTOR EQUAL TO A DIFFERENCE BETWEEN THE AVERAGE ACTUAL FIDUCIAL DISTANCE AND THE IMAGING ENGINE FEED DISTANCE DIVIDED BY A TOTAL NUMBER OF DISCRETE INCREMENTAL MOVES BETWEEN CONSECUTIVE FIDUCIALS 53 and ADJUSTING THE IMAGING ENGINE FEED DISTANCE IN AN AMOUNT EQUAL TO THE SCALING FACTOR 54.

Figure 4:
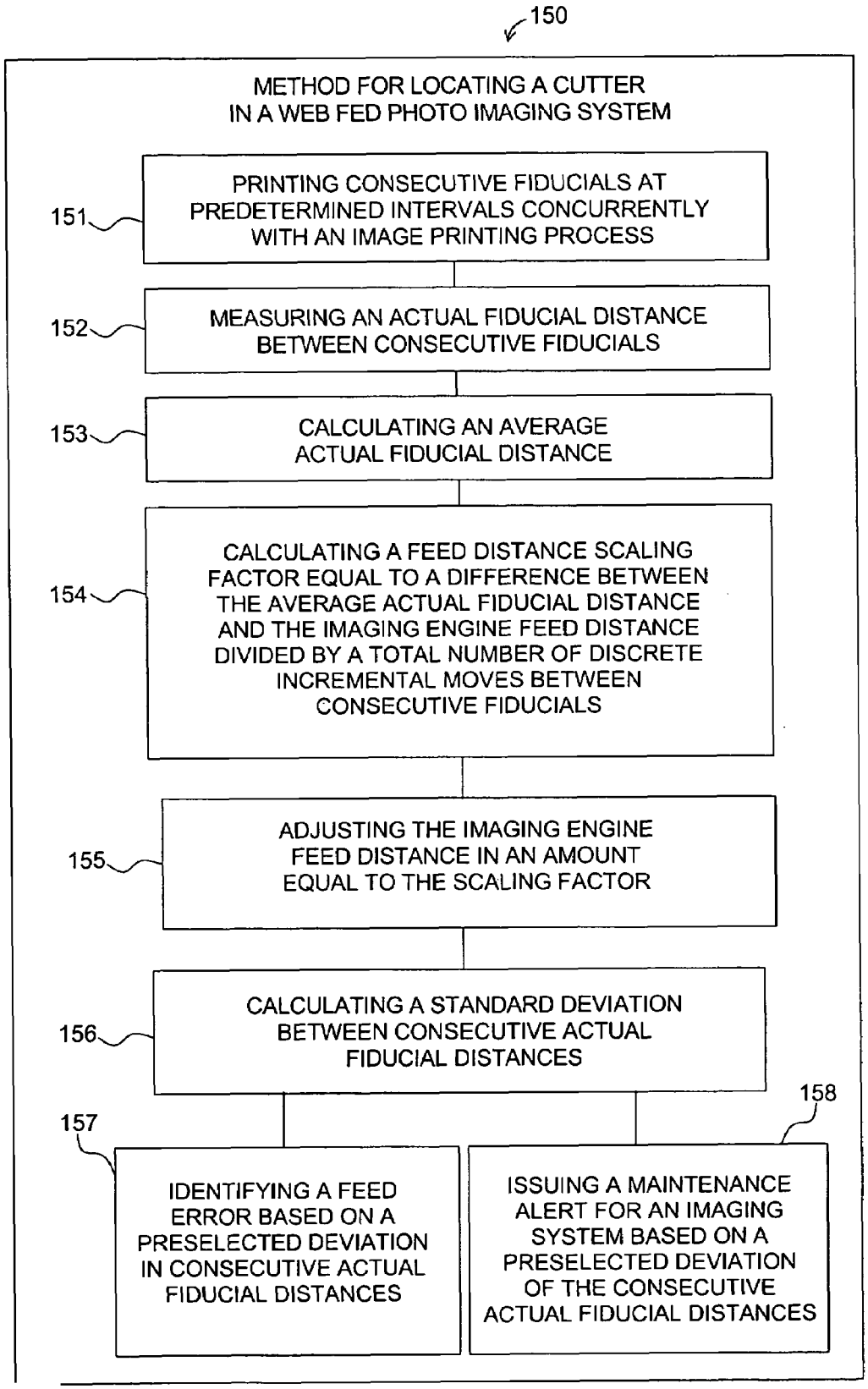
FIG. 4 is a schematic flow chart depicting a method for locating a cutter in a web fed photo imaging system according to one embodiment of the present invention.

Referring to FIG. 4, an alternate preferred embodiment of a METHOD FOR LOCATING A CUTTER IN A WEB FED PHOTO IMAGING SYSTEM 150 is shown to advantage. The METHOD FOR LOCATING A CUTTER IN A WEB FED PHOTO IMAGING SYSTEM 150 includes the steps of PRINTING CONSECUTIVE FIDUCIALS AT PREDETERMINED INTERVALS CONCURRENTLY WITH AN IMAGE PRINTING PROCESS 151, MEASURING AN ACTUAL FIDUCIAL DISTANCE BETWEEN CONSECUTIVE FIDUCIALS 152, CALCULATING AN AVERAGE ACTUAL FIDUCIAL DISTANCE 153, CALCULATING A FEED DISTANCE SCALING FACTOR EQUAL TO A DIFFERENCE BETWEEN THE AVERAGE ACTUAL FIDUCIAL DISTANCE AND THE IMAGING ENGINE FEED DISTANCE DIVIDED BY A TOTAL NUMBER OF DISCRETE INCREMENTAL MOVES BETWEEN CONSECUTIVE FIDUCIALS 154 and ADJUSTING THE IMAGING ENGINE FEED DISTANCE IN AN AMOUNT EQUAL TO THE SCALING FACTOR 155. As shown in FIG. 4, a METHOD FOR LOCATING A CUTTER IN A WEB FED PHOTO IMAGING SYSTEM 150 may also include the steps of CALCULATING A STANDARD DEVIATION BETWEEN CONSECUTIVE ACTUAL FIDUCIAL DISTANCES 156 and IDENTIFYING A FEED ERROR BASED ON A PRESELECTED DEVIATION IN CONSECUTIVE ACTUAL FIDUCIAL DISTANCES 157. The METHOD FOR LOCATING A CUTTER IN A WEB FED PHOTO IMAGING SYSTEM 150 may also include the step of ISSUING A MAINTENANCE ALERT FOR AN IMAGING SYSTEM BASED ON A PRESELECTED DEVIATION OF THE CONSECUTIVE ACTUAL FIDUCIAL DISTANCES 158.

The step of MEASURING AN ACTUAL FIDUCIAL DISTANCE BETWEEN CONSECUTIVE FIDUCIALS 51 may include measuring an actual fiducial distance between a first fiducial F1 located near a first cutline CL1 and a second fiducial F2 located near a second cutline CL2 as shown in FIG. 1. In the alternative, the step of MEASURING AN ACTUAL FIDUCIAL DISTANCE BETWEEN CONSECUTIVE FIDUCIALS 152 may include measuring an actual fiducial distance between a multiple consecutive fiducials, for instance F10–F14 located between a first cutline CL1 and a second cutline CL2, as shown in FIG. 2. Additionally, the step of MEASURING AN ACTUAL FIDUCIAL DISTANCE BETWEEN CONSECUTIVE FIDUCIALS 51 or 152 may include measuring an actual fiducial distance D2 between consecutive fiducials, for example F2 and F3 shown in FIG. 1, said measurement being taken by sensor 35 located at the location of cutter 32.

The step of CALCULATING A FEED DISTANCE SCALING 53 or 154 may include, for instance referring to FIG. 1, calculating a feed distance scaling factor equal to a difference between the average actual fiducial distance D2 and an imaging engine feed distance D1 and dividing the difference by a total number of discrete incremental moves between fiducials. Alternately, the step of CALCULATING A FEED DISTANCE SCALING FACTOR 53 or 154 may, for instance referring to FIG. 2, calculating a feed distance scaling factor equal to a difference between the average actual fiducial distances D11 through D14 and an imaging engine feed distance D10 and dividing the difference by a total number of discrete incremental moves between fiducials. Additionally, the step of CALCULATING A FEED DISTANCE SCALING FACTOR 53 or 154 may include calculating a feed distance scaling factor based on an imaging engine feed distance D1 input at imaging engine 20, or in the alternative an imaging engine feed distance D1 actually measured at imaging engine 20.

Although the present invention has been described with reference to specific embodiments, those of skill in the art will recognize that changes may be made thereto without departing from the scope and spirit of the invention as defined by the appended claims.

What is claimed is:

1. A method for locating a cutter in a web fed photo imaging system including the steps of:

measuring an actual fiducial distance between consecutive fiducials;

calculating an average actual fiducial distance between consecutive fiducials;

calculating a feed distance scaling factor equal to a difference between an average actual fiducial distance and an imaging engine feed distance divided by a total number of discrete incremental moves between consecutive fiducials; and adjusting the imaging engine feed distance in an amount equal to the scaling factor.

2. The method for locating a cutter of claim 1 wherein the step of measuring an actual fiducial distance between consecutive fiducials further comprises measuring an actual fiducial distance between consecutive fiducials at a cutter location.

3. The method for locating a cutter of claim 1 wherein the step of measuring an actual fiducial distance between consecutive fiducials further comprises measuring an actual fiducial distance between a first fiducial located near a first cutline of a media and a second fiducial located near a second cutline of the media.

4. The method for locating a cutter of claim 1 wherein the step of measuring an actual fiducial distance between consecutive fiducials further comprises:

measuring an actual fiducial distance between multiple consecutive fiducials located along a length of an image, each of the multiple consecutive fiducials located at an equal preselected distance one from the next; and dynamically updating the scaling factor and the imaging engine feed distance.

5. The method for locating a cutter of claim 1 wherein the step of measuring an actual fiducial distance between consecutive fiducials further comprises measuring an actual fiducial distance between consecutive fiducials with a sensor of a cutter control system.

6. The method for locating a cutter of claim 1 wherein the step of calculating a feed distance scaling factor equal to a difference between an average actual fiducial distance and an imaging engine feed distance divided by a total number of discrete incremental moves between consecutive fiducials further comprises calculating a feed distance scaling factor equal to a difference between the average actual fiducial distance and an imaging engine feed distance input at the imaging engine divided by a total number of discrete incremental moves between consecutive fiducials.

7. The method for locating a cutter of claim 1 wherein the step of calculating a feed distance scaling factor equal to a difference between an average actual fiducial distance and the imaging engine feed distance divided by a total number of discrete incremental moves between consecutive fiducials further comprises calculating a feed distance scaling factor based on a difference between the average actual fiducial distance and an imaging engine feed distance measured at the imaging engine divided by a total number of discrete incremental moves between consecutive fiducials.

8. The method for locating a cutter of claim 1 further comprising the steps of:

calculating a standard deviation of consecutive actual fiducial distances; and identifying feed errors based on a preselected deviation in consecutive actual fiducial distances.

9. The method for locating a cutter of claim 1 further comprising the steps of:

calculating a standard deviation of consecutive actual fiducial distances; and issuing a maintenance alert for an imaging system based on a preselected deviation in consecutive actual fiducial distances.

10. A method for locating a cutter in a web fed photo imaging system including the steps of:

printing consecutive fiducials at predetermined intervals concurrently with an image printing process;

measuring an actual fiducial distance between consecutive fiducials;

calculating an average actual fiducial distance between consecutive fiducials;

calculating a feed distance scaling factor equal to a difference between an average actual fiducial distance and an imaging engine feed distance divided by a total number of discrete incremental moves between fiducials; and adjusting the imaging engine feed distance in an amount equal to the scaling factor.

11. The method for locating a cutter of claim 10 wherein the step of measuring an actual fiducial distance between consecutive fiducials further comprises measuring an actual fiducial distance between consecutive fiducials at a cutter location.

12. The method for locating a cutter of claim 10 wherein the step of measuring an actual fiducial distance between consecutive fiducials further comprises measuring an actual fiducial distance between a first fiducial located near a first cutline of a media and a second fiducial located near a second cutline of the media.

13. The method for locating a cutter of claim 10 wherein the step of measuring an actual fiducial distance between consecutive fiducials further comprises:

measuring an actual fiducial distance between multiple consecutive fiducials located along a length of an image, each of the multiple consecutive fiducials located at an equal preselected distance one from the next; and dynamically updating the scaling factor and the imaging engine feed distance.

14. The method for locating a cutter of claim 10 wherein the step of measuring an actual fiducial distance between consecutive fiducials further comprises measuring an actual fiducial distance between consecutive fiducials with a sensor of a cutter control system.

15. The method for locating a cutter of claim 10 wherein the step of calculating a feed distance scaling factor equal to a difference between an average actual fiducial distance and an imaging engine feed distance divided by a total number of discrete incremental moves between consecutive fiducials further comprises calculating a feed distance scaling factor equal to a difference between the average actual fiducial distance and an imaging engine feed distance input at the imaging engine divided by a total number of discrete incremental moves between consecutive fiducials.

16. The method for locating a cutter of claim 10 wherein the step of calculating a feed distance scaling factor based on a difference between an average actual fiducial distance and an imaging engine feed distance divided by a total number of discrete incremental moves between consecutive fiducials further comprises calculating a feed distance scaling factor based on a difference between the average actual fiducial distance and an imaging engine feed distance measured at the imaging engine divided by a total number of discrete incremental moves between consecutive fiducials.

17. The method for locating a cutter of claim 10 further comprising the steps of:

calculating a standard deviation of consecutive actual fiducial distances; and identifying feed errors based on a preselected deviation in consecutive actual fiducial distances.

18. The method for locating a cutter of claim 10 further comprising the steps of:

calculating a standard deviation of consecutive actual fiducial distances; and issuing a maintenance alert for an imaging system based on a preselected deviation in consecutive actual fiducial distances.

* * * * *